United States Patent [19]

Yamauchi et al.

[11] Patent Number: 4,516,331

[45] Date of Patent: May 14, 1985

[54] DRYING APPARATUS HAVING RECYCLE AIR PATH

[75] Inventors: Toshiaki Yamauchi, Aichi; Tsuneo Hibi, Gifu; Kiyomi Sasano, Ichinomiya; Yoshiki Hayashi, Nagoya, all of Japan

[73] Assignee: Tokyo Shibaura Denki Kabushiki Kaisha, Japan

[21] Appl. No.: 399,872

[22] Filed: Jul. 19, 1982

[30] Foreign Application Priority Data

Sep. 16, 1981 [JP] Japan ..... 56-146625

[51] Int. Cl.[3] ..... F26B 11/04

[52] U.S. Cl. ..... 34/77; 34/133

[58] Field of Search ..... 34/77, 86, 131, 133; 68/186

[56] References Cited

U.S. PATENT DOCUMENTS

| | | | |
|---|---|---|---|
| 2,676,418 | 4/1954 | Shewmon | 34/131 |
| 3,032,887 | 5/1962 | Whyte et al. | 34/77 |
| 4,348,818 | 9/1982 | Brown | 34/86 |

FOREIGN PATENT DOCUMENTS

| | | | |
|---|---|---|---|
| 49-30953 | 3/1974 | Japan . | |
| 54-101658 | 7/1979 | Japan . | |
| 2002891 | 2/1979 | United Kingdom | 34/77 |

*Primary Examiner*—Larry I. Schwartz
*Assistant Examiner*—David W. Westphal
*Attorney, Agent, or Firm*—Cushman, Darby & Cushman

[57] ABSTRACT

The drying apparatus includes a drum rotatably arranged in an outer box with a certain distance spaced from the inner surface of the outer box and housing therein materials to be dried. An air supply device supplies heated air into the drum, and a moisture removing device cooles air discharged from the drum by means of air taken from outside of the outer box to remove moisture from air discharged. Air discharged from the drum is guided to the moisture removing device through a first path. A space defined by the inner surface of the outer box and the outer surface of the drum constitutes a second path through which air passed through the moisture removing device is guided to the air supply device.

18 Claims, 7 Drawing Figures

DRYING APPARATUS HAVING RECYCLE AIR PATH

BACKGROUND OF THE INVENTION

The present invention relates to a drying apparatus and, more particularly, a drying apparatus wherein air containing moisture and discharged from a drum is dried by means of a heat exchanger and again supplied to the drum.

The drying apparatus usually has an outer box and a drum arranged rotatably in the outer box wherein garmet materials such as underwear for example, housed in the drum are dried by supplying hot air into the drum. In a conventional drying apparatus, hot damp air discharged from the drum is not discharged outside the outer box but rather is dried by a heat exchanger arranged in the outer box and heated by a heater to be supplied into the drum again. Hot damp air discharged from the drum does not leak outside the outer box. The humidity in the room therefore does not rise, and the persons working in the room do not feel unpleasant. However, such a conventional drying apparatus must have therein a duct for guiding air discharged from the drum to the heat exchanger and another duct for guiding air passed through the heat exchanger to the drum via the heater. Therefore, its structure inside the outer box becomes complicated and high in cost. In addition, such a conventional drying apparatus uses only the heat exchanger to remove moisture, thus causing its moisture removing efficiency to be low. Further, when a part of hot moist air leaks inside the outer box through the connected portion of each of the ducts and through the bearing portion of the drum, this leaked hot moist air is discharged outside the outer box since it does not pass through the heat exchanger, thus increasing the humidity in the room.

SUMMARY OF THE INVENTION

The present invention is intended to eliminate the above-mentioned drawbacks and the object of the present invention is therefore to provide a drying apparatus simple in construction and low in cost and capable of removing enough moisture from air discharged from the drum to prevent humidity in the room from becoming high.

According to one aspect of the present invention, the drying apparatus comprises a tightly closed outer box, a drum rotatably arranged in the outer box with a certain distance spaced from the inner surface of the outer box for housing therein materials to be dried, an air supply means for supplying heated air into the drum, a moisture removing means for cooling air discharged from the drum by means of air taken from outside of the outer box to remove moisture from the discharged air, a first path through which air discharged from the drum is guided to the moisture removing means, and a second path through which air passed through the moisture removing means is guided to the air supply means and which is defined by the inner surface of the outer box and the outer surface of the drum.

According to this drying apparatus, the second path is formed as a space between the outer box and the drum, so that a particular member such as a duct, for example, is not needed to form the second path, thus simplifying the arrangement of the outer box and lowering its costs. In addition, air containing moisture and discharged from the drum is passed through the heat exchanger to remove its moisture and then further cooled to remove additional moisture contacting the inner surface of the outer box in the second path or the space, thereby enabling higher moisture removing efficiency to be achieved as compared with conventional drying apparatus. Further, even if moist air leaks into the space through the bearing portion of the drum and the first path, the space is filled with air whose moisture has been removed by the heat exchanger, and this moisture-removed air is mixed with leaked moist air. Therefore, the leaked air is reduced in humidity, thus enabling humidity in the room to be kept as low as possible even if air leaks outside the outer box.

BRIEF DESCRIPTION OF THE DRAWINGS

FIGS. 1 through 5 show a first embodiment of drying apparatus according to the present invention, in which FIG. 1 is a front view, FIG. 2 a sectional view taken along a line II—II in FIG. 1, FIG. 3 a sectional view taken along a line III—III in FIG. 1, FIG. 4 a partly taken out side view, and FIG. 5 a sectional view taken along a line V—V in FIG. 1;

DETAILED DESCRIPTION OF THE PREFERRED EMBODIMENTS

Figure 1:
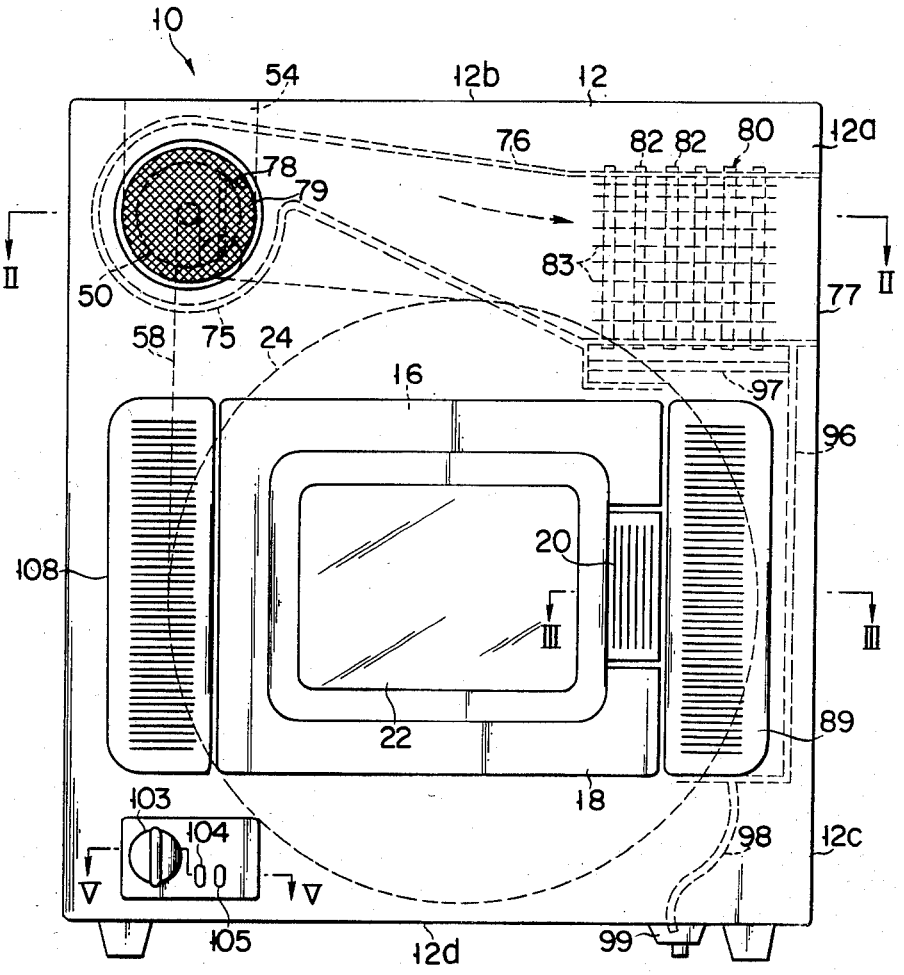

A first embodiment of the present invention will be described referring to FIGS. 1 through 5. A drying apparatus 10 has an outer box 12 formed as a rectangular solid, and a drum 24 arranged rotatably in the outer box 12. The drum 24 is arranged with a certain distance spaced from the inner surface of the outer box 12 and a space 25 is defined by the inner surface of the outer box and the outer surface of the drum. A rectangular opening 16 through which materials to be dried such as underwear, for example, are put into or taken out of the drum 24 is formed in the center of a front plate 12*a* of the outer box 12. A side-hinged door 18 for closing the opening 16 is attached to the front plate 12*a* and provided with a handle 20 at the right end side thereof. Door 18 includes a transparent glass window 22 in the center thereof.

Figure 2:
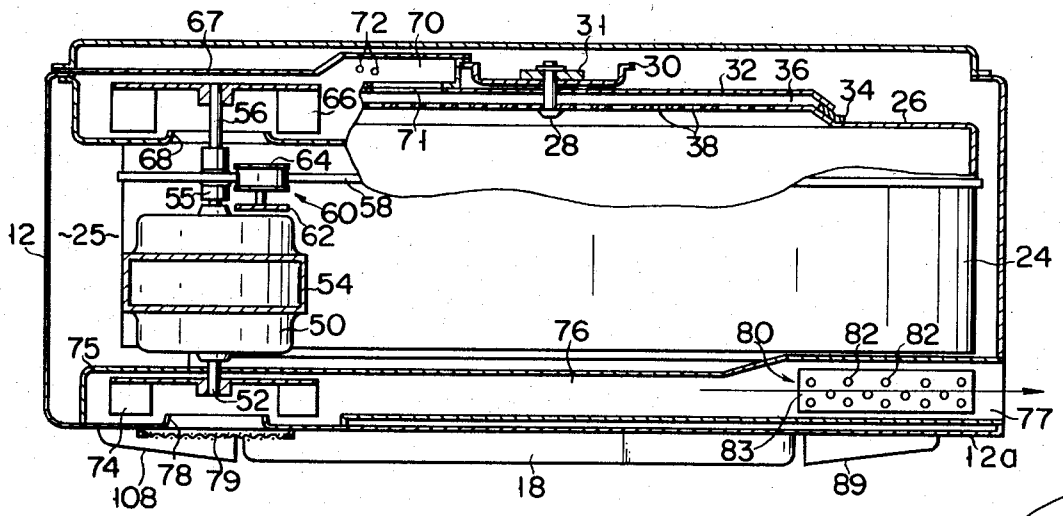

As apparent from FIG. 2, the drum 24 is of cylindrical shape and closed at the back end portion thereof by an end plate 26. The end plate 26 has a support rod 28 projected backward through the center thereof. The support rod 28 is rotatingly supported by a support plate 30 through a bearing 31 both being arranged in the outer box 12. A wind spreading member 32 of circular tray shape is fixed to the support plate 30, coaxial with the drum 24 and parallel to the end plate 26. The circumference of the wind spreading member 32 is airtightly contacted with the end plate 26 with a sealing member 34 interposed therebetween, thus defining a cavity 36 between the wind spreading member and the end plate 26. The end plate 26 is provided with a plurality of ventilating holes 38 for communicating the cavity 36 with the inside of the drum 24. As apparent from FIG. 3, the drum 24 is provided with a ring-shaped end plate 40 at the front end portion thereof, and this end plate 40 has a cylinder portion 42 formed coaxial with the drum. The cylinder portion 42 is rotatingly supported by a drum support plate 44 which is arranged on the back side of front plate 12*a* of the outer box 12 with a certain distance spaced from the front plate. The drum support plate 44 is provided with a cylinder portion 46 located enclosing the opening 16 in the front plate 12*a* and communicating with it. The drum support plate 44 is also provided with a circular support groove 48 formed coaxial with the drum 24 and enclosing the opening 16. The cylinder portion 42 of the drum 24 is rotatingly supported in the support groove 48 through a bearing member 49.

The drying apparatus 10 includes a motor 50 as a driving means for driving the drum 24. The motor 50 is fixed through an attaching base 54 to an upper face plate 12*b* of outer box 12 in such a way that its rotating shaft is positioned parallel to the center axis of the drum 24. To the back end portion of rotating shaft 52 is connected a connecting shaft 56 provided with a pulley 55. A belt 58 is stretched between the outer circumference of the drum 24 and the pulley 55 and tensioned by a tension means 60, which includes an arm 62 rotatably supported by the attaching base 54, a pulley 64 attached to the foremost end of arm and contactable with the belt 58, and an urging member (not shown) for urging the arm 62 to forcedly contact the pulley 64 with the belt. The drum 24 is rotated by the motor 50 through the belt 58 and the pulley 55. To the connecting shaft 56 is fixed a fan 66, which is covered by a fan casing 67 fixed to the outer box 12. The fan casing 67 is provided with a suction opening 68 opened inward the outer box 12 and communicated with an end of a duct 70. The other end of duct 70 communicates with a communication opening 71 formed in the wind spreading member 32. A heater 72 for heating air passing through the inside of the duct 70 is arranged in the duct 70. The heater 72, duct 70 and fan 66 serve as an air supply means for supplying hot wind into the drum 24.

A fan 74 is attached to the foremost end of the rotating shaft 52 of motor 50 and covered by a fan casing 75 fixed to the front plate 12*a* of the outer box 12. The fan 74 and fan casing 75 form a fan means. The fan casing 75 communicates with an end of a blowing duct 76. The other end of the blowing duct 76 communicates with a discharging opening 77 formed in a right side plate 12*c* of the outer box 12. An air suction opening 78 is formed in the front plate 12*a* at a position opposite to the fan 74 and a filter 79 is attached to the air suction opening 78.

A heat exchanger 80 is arranged in the blowing duct 76, adjacent to the discharging opening 77. The heat exchanger 80 has a plurality of air tubes 82 arranged parallel to one another, and a plurality of radiating fins 83 arranged parallel to one another, and its respective air tubes are penetrated, perpendicular, through their respective radiating fins, as shown FIG. 4. The heat exchanger 80 has its air tubes 82 crossed perpendicular to the blowing duct 76. Respective air tubes 82 are not communicated with the blowing duct 76 but their upper and lower ends project outside the duct 76. The upper ends of the air tubes 82 communicate with the space 25 formed between the outer box 12 and the drum 24. The heat exchanger 80, fan 74 and blowing duct 76 form a moisture removing means.

Figure 3:
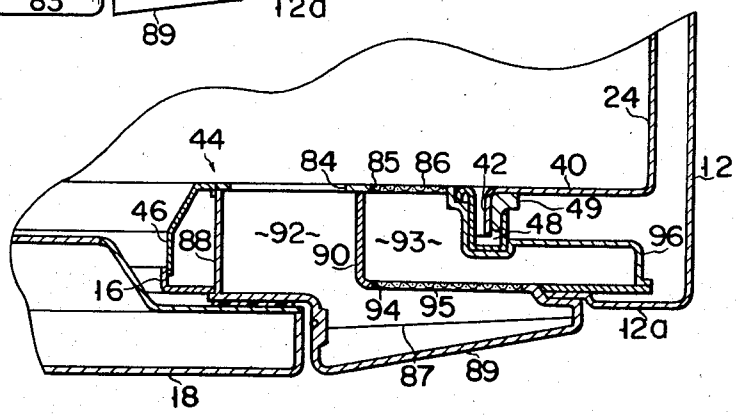
Figure 4:
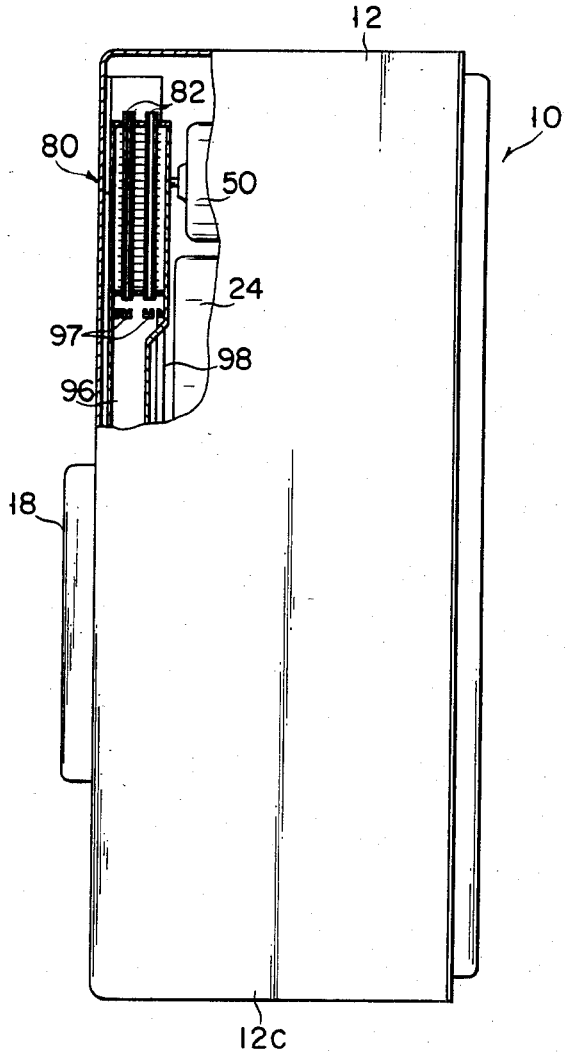

As apparent from FIG. 3, first and second air discharging openings 84 and 85 are formed in the drum support plate 44, adjacent to the right side of the opening 16 and communicates with the inside of the drum 24. A lint filter 86 is attached to the second air discharging opening 85. An opening 87 is formed in the front plate 12*a*, opposite to the first and second air discharging openings 84 and 85, and communicates with the first and second air discharging openings through a ventilator 88. The opening 87 is closed by a checking cover 89 which is detachably attached to the front plate 12*a*. The ventilator 88 is separated by a partition wall 90 to a ventilating path 92 communicated with the first air discharging opening 84 and to a ventilating path 93 communicated with the second air discharging opening 85. An opening 94 for communicating the ventilating path 92 with the one 93 is formed at a position opposite to the opening 87 in the partition wall 90 and a lint filter 95 is attached to the communication opening 94. The ventilating path 93 communicates with one end of a ventilating duct 96 and the other end of the duct 96 is connected to the underside of the blowing duct 76. Lower ends of respective air tubes 82 in the heat exchanger 80 project into the ventilating duct 96. Therefore, the inside of the drum 24 communicates with the heat exchanger 80 through the ventilating paths 92, 93 and duct 96. As apparent from FIG. 4, water receiving troughs 97 are arranged in the duct 96, opposite to respective lower ends of the air tubes 82 and with a certain distance spaced from one another. A drain tube 98 is arranged along the duct 96 with its one end communicating with the water receiving trough 97 and with its other end communicated with a drain hole 99 formed in a bottom plate 12*d* of the outer box 12.

Figure 5:
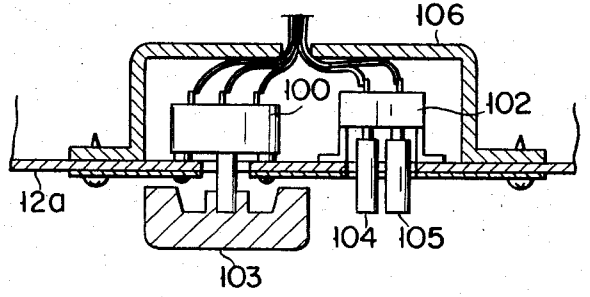

As apparent from FIG. 5, the drying apparatus 10 includes a timer 100 and a switch 102 arranged on the front plate 12*a* of the outer box 12. The timer 100 has an operating knob 103 and the switch 102 has push buttons 104 and 105. The timer 100 and the switch 102 are covered by a cover 106 fixed on the underside of the front plate 12*a* by means of screws and kept air-tight from the inside of the outer box 12. Reference numeral 108 in FIG. 2 represents a face panel arranged adjacent to the left side of the door 18 and symmetrical to the checking cover 89.

The operation of drying apparatus thus arranged will be described.

Materials such as garments to be dried are put into the drum 24 through the opening 16, which is then closed by the door 18. When the timer 100 is set, the motor 50 is rotated and the heater 72 is heated. The rotation of motor 50 causes the fans 66 in addition to 74 to be rotated and the drum 24 being rotated by the belt 58. When the push button 104 is pushed, the entire heater 72 is heated while, when the push button 105 is pushed, only a part of heater is made conductive. The change-over switch is selected depending upon the volume and kind materials to be dried. When the fan 66 is rotated, air in the space 25 between the outer box 12 and the drum 24 is sucked into the fan casing 67 through the opening 68 and fed into the duct 70. When passing through the duct 70, this air is heated by the heater 72 to hot air, which is passed through the communication opening 71 into the cavity 36 in the wind spreading member 32 and then supplied through the ventilating holes 38 into the drum 24. Hot air supplied in the drum 24 passes through and around the materials stirred in the drum 24 and becomes fully moisten taking moisture from the materials to be dried, and discharged through the first and second air discharging openings 84 and 85. Air discharged through the first air discharging opening 84 enters into the ventilating path 93 through the ventilating path 92 and the lint filter 95, while air discharged through the second air discharging opening 86 also enters into the ventilating path 93 through the lint filter 86, where they are mixed with each other and then fed to the heat exchanger 80 through the ventilating duct 96. The duct 96 and the ventilator 88 serve as a first path through which air discharged from the drum 24 is introduced to the heat exchanger 80. Air fed to the heat exchanger 80 passes through the air tubes 82 into the space 25 between the outer box 12 and the drum 24. On the other hand, the rotation of the fan 74 causes air to be sucked from outside of the outer box 12 into the fan casing 75 through the opening 78 and the filter 79 and then to be fed to the heat exchanger 80 through the blowing duct 76. This air taken from outside passes along the radiating fins 83 and around the air tubes 82 in the heat exchanger 80 to cool the air tubes and is then discharged outside the outer box 12 through the air discharging opening 77. Hot damp air is cooled passing through air tubes 82 and cooling thereof causes moisture to due on the inner surface of each air tube, 82 thereby becoming dried air of low temperature, which is discharged into the space 25 through the upper ends of the air tubes 82. Since the outer box 12 is low in temperature by virtue of its direct contact with outside air, air discharged into the space 25 is further cooled by contact with the inner surface of the outer box 12 and thus moisture is removed in the form of dew on the inner surface of the outer box 12. Dried air of low temperature filled in the space 25 is again sucked by the fan 66 into the fan causing 67 through the opening 68 and supplied into the drum 24 after heated by the heater 72. The space 25 serves as a second path through which air discharged from the heat exchanger 80 is introduced to the air supply means. As described above, the materials housed in the drum 24 are dried by air circulated through the outer box 12. On the other hand, water on the inner surface of each air tube 82 drops in the water receiving trough 97 along the inner surface of each air tube 82 and then flows through the drain tube 98 to be discharged outside the outer box 12 through the drain opening 99. Water on the inner surface of the outer box 12 however also flows therealong and is discharged outside the outer box 12 through the drain opening 99.

According to the drying apparatus described above, air laden with moisture removed from the materials in the drum 24 is cooled and dried by the heat exchanger 80. The cooled and dried air is then introduced to the air supply means passing through the space 25 defined by the inner surface of the outer box 12 and the outer surface of the drum 24 and which serves as the second path, and is again heated by the heater 72 and re supplied into the drum 24. Therefore, the drying apparatus 10 makes it unnecessary to provide a particular member such as duct, for example, which serves as the second path for introducing air discharged from the heat exchanger 80 to the air supply means, thus reducing the number of parts employed simplifying the arrangement and assembly of outer box 12 and lowering the cost thereof. In addition, initially cooled and dried air passing through the heat exchanger 80 is further cooled and dried by contact with the inner surface of the outer box 12. Therefore, the drying apparatus of the present invention enables a higher moisture-removing efficiency to be achieved as compared with conventional dryers. Even when moisture-laden air in the drum 24 leaks through the cylindrical portion 42 of the end plate 40 or the connected portion between the ventilator 88 and the duct 96, the space 25 in the outer box 12 is filled with air dried by the heat exchanger 80, so that moist air which may leak into the outer box is mixed with such dried air in the space 25 thereby reducing the humidity of the combined air. If air in the outer box 12 should leak outside, therefore, it will negligibly increase the humidity in the room. Further, air in the outer box 12 is usually sucked by the fan 68 and thus very little of air passing through the space 25 leaks outside the outer box, thereby reliably preventing increase of humidity in the room. Since the timer 100 and the changeover switch 102 are covered and separated air-tightly by the cover 106 from the space 25, these electric parts are insulated from the air passing through the space 25 thus preventing moisture degradation thereof. Furthermore, the lint filter 86 attached to the second air discharging opening 85 is positioned to be in contact with the materials in the drum 24. Therefore, lint adhered to the lint filter 86 is removed by the materials when they contact the filter 86 thus preventing the lint filter 86 from becoming jammed. Even when the lint filter 95 is jammed, air in the drum 24 is discharged through the lint filter 86 thus preventing the heater 72 from becoming overheated.

Figure 6:
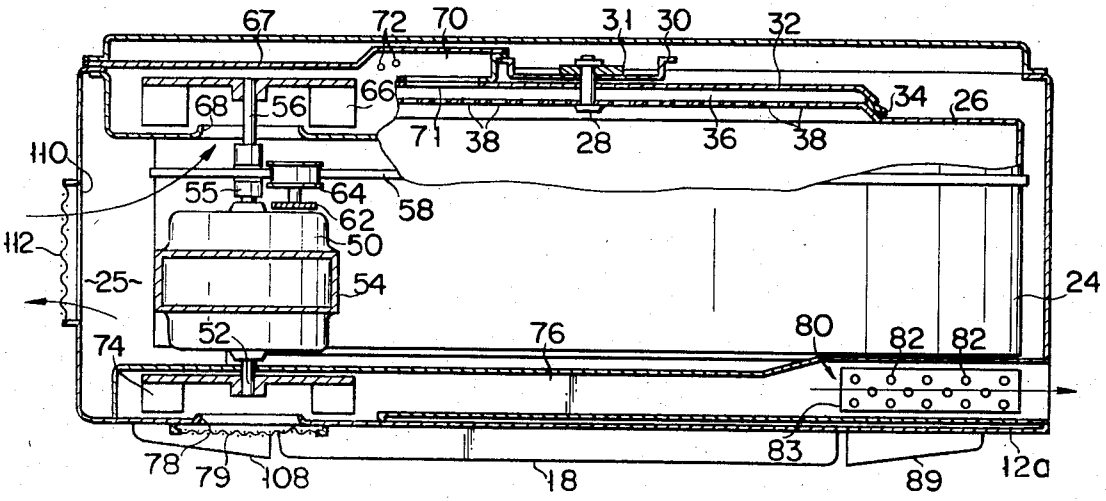
FIG. 6 is a sectional view showing a second embodiment of drying apparatus according to the present invention.

A second embodiment of the present invention will be described referring to FIG. 6. Parts different from those in the first embodiment will be described. A ventilating opening 110 is formed in the left side plate of the outer box 12 at a position opposite to the motor 50, and a filter 112 is attached to the ventilating opening 110. The sucking action of the fan 66 causes air to be sucked from outside into the space 25 through the ventilating opening 110 and then to be fed around the motor 50. The same volume of air in the space 25 as that of air sucked is simultaneously discharged through the ventilating opening 110. According to the second embodiment, therefore, a part of air containing a little moisture in the space 25 is discharged outside the outer box 12 and exchanged with air from the outside which also contains little moisture. Air in the space 25 is thus reduced in humidity and makes it easier to take moisture from the materials in the drum 24, thus allowing drying efficiency to be enhanced. In addition, the motor 50 is more effectively cooled by air sucked from outside through the ventilating opening 110.

Figure 7:
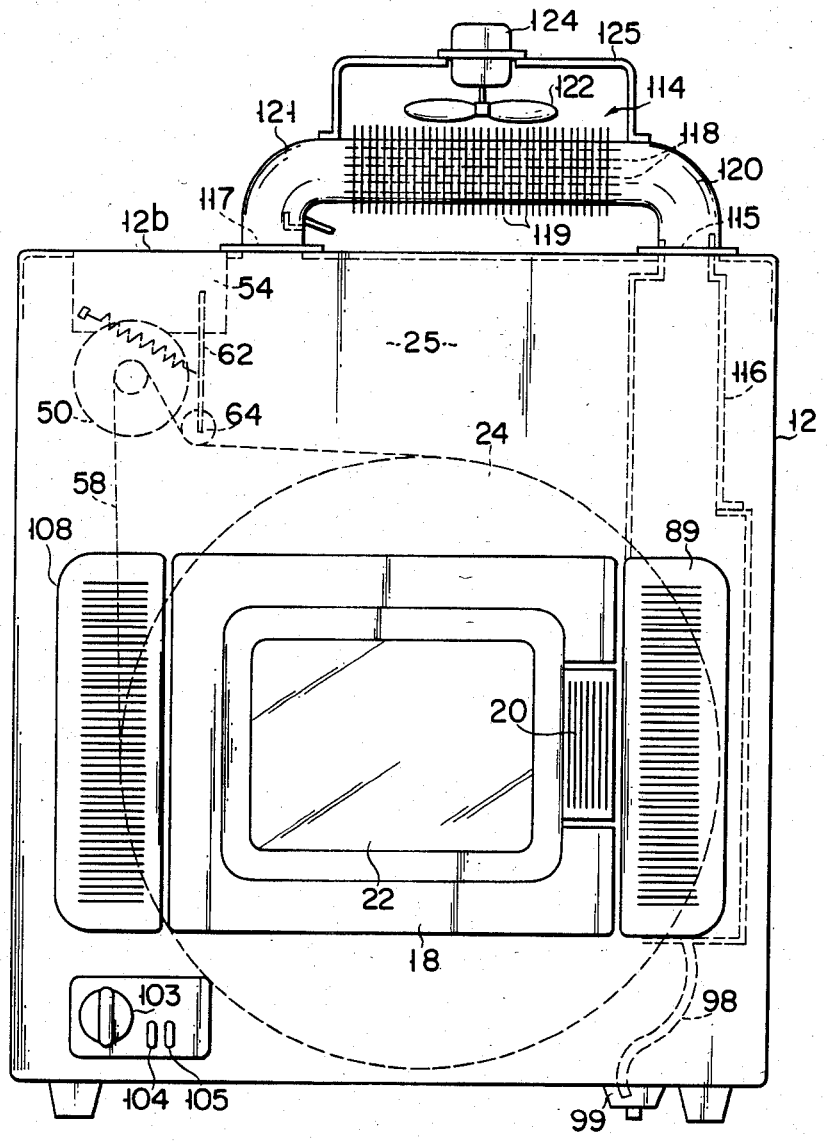
FIG. 7 is a front view showing a third embodiment of drying apparatus according to the present invention.

Referring to FIG. 7, a third embodiment of the present invention will be described only on the basis of those parts different from the first embodiment. A heat exchanger 114, which forms a moisture-removing means, is arranged on the outside of the outer box 12 in this embodiment. An air discharging opening 115 is formed in the upper side plate **12*b* of the outer box 12 and communicated with the ventilator 88 (see FIG. 3) through a duct 116. An inlet 117 is formed in the upper side plate 12*b* with a certain distance spaced from the air discharging opening 115, and communicated directly with the space 25. The heat exchanger 114 is detachably arranged between the air discharging opening 115 and the inlet 117. The heat exchanger 114 has a plurality of air tubes 118 and a plurality of radiating fins 119, and also had L-shaped connection tubes 120 and 121 connected to respective ends of air tubes 118. Connection tubes 120 and 121 are detachably connected to the air discharge opening 115 and the inlet 117, respectively. A fan 122 and a motor 124, which serve as a moisture-removing means, are attached to the heat exchanger 114 by means of a support leg 125. The motor 124 is energized at the same time as motor 50 for driving the drum 25 to thereby blow air outside to the heat exchanger 114 so as to cool its air tubes 118. Air which has carried moisture in the drum 24 is fed to the heat exchanger 114 via the ventilator 88, duct 116 and air discharging opening 115, cooled and moisture is removed by passing the air through the air tubes 118. The cooled and dried air is then supplied into the space 25 through the inlet 117**.

This embodiment also enables the same function and effects to be attained as in the first embodiment. According to the third embodiment, if the drying apparatus is used under such conditions that moisture-laden air is allowed to be discharged into the room, drying efficiency can be enhanced in such a way that the heat exchanger 114 is so detached as to allow moist air to be discharged outside directly through the air discharging opening and air outside to be sucked into the spaced 25 through the inlet. According to the third embodiment, therefore, the heat exchanger 114 can be employed depending upon the condition in the room where the drying apparatus is installed, seasons and the like.

What we claim is:

1. A drying apparatus comprising:

an outer box sealed substantially air-tightly;

a drum in which materials to be dried are housed, said drum rotatably arranged in the outer box and spaced from the inner surface of the outer box by a certain distance;

driving means for rotating the drum;

air supply means for supplying heated air into the drum to remove moisture from the materials to be dried;

moisture-removing means for cooling moist air discharged from the drum with air supplied from the outside of the outer box, to remove moisture from the discharged air;

a first path through which the moist air discharged from the drum is introduced to the moisture-removing means, said first path being defined by (a) a ventilator having one end in communication with the drum, and (b) a ventilating duct having one end in communication with the moisture-removing means, said ventilator and ventilating duct communicating with each other at the other ends thereof;

a first lint filter attached to said one end of the ventilator and positioned so as to be capable of contact with the materials in the drum whereby accumulated lint adhered to said first lint filter is effectively removed therefrom by virtue of the materials in the drum coming into contact therewith; and a second path through which air, whose moisture has been removed by the moisture-removing means, is introduced to the air supply, said second path being defined by the inner surface of the outer box and the outer surface of the drum, wherein air discharged from the drum is again supplied into the drum through the first path, moisture-removing means, second path and air supply means.

2. A drying apparatus according to claim 1 wherein said air supply means includes a duct having an end thereof communicating with the inside of the drum and the other end thereof communicating with the second path, a heater arranged in the duct, and a fan driven by the driving means to send air in the second path into the duct.

3. A drying apparatus according to claim 1 wherein said moisture-removing means includes a heat exchanger having an end thereof communicating with the first path and the other end thereof communicating with the second path, and a fan means driven by the driving means to send air from outside to the heat exchanger.

4. A drying apparatus according to claim 3 wherein said moisture-removing means is detachably attached to the outer surface of the outer box.

5. A drying apparatus according to claim 3 wherein said moisture-removing means further includes a blowing duct arranged in the outer box and having both ends thereof communicating with the outside of the outer box, the heat exchanger is arranged in the blowing duct, and the fan means is arranged in the blowing duct in such a way that it can suck air through one end of the blowing duct and send it to the other end of the blowing duct.

6. A drying apparatus according to claim 5 wherein said heat exchanger has a plurality of air tubes which are arranged parallel to one another and through which air discharged from the drum passes, and a plurality of radiating fins arranged parallel to one another, the respective air tubes passing, perpendicular, through the respective radiating fins.

7. A drying apparatus according to claim 6 wherein said air tubes of the heat exchanger are arranged so as to not be in communication with the blowing duct but cooled by air outside passing through the blowing duct.

8. A drying apparatus according to claim 7 wherein said air tubes of the heat exchanger are in communication at one of the ends thereof with the first path and at the other ends thereof with the second path.

9. A drying apparatus according to claim 1 wherein said outer box has a ventilating opening communicating with the second path.

10. A drying apparatus according to claim 9 wherein said ventilating opening is formed is a position opposite to the driving means.

11. A drying apparatus according to claim 1 which further includes plural electric parts arranged in the outer box, and a cover for covering the electric parts so sealingly separate them from moisture in the space.

12. A drying apparatus according to claim 1, wherein the inside of said ventilator is divided into a first ventilating path which is open to the drum at one end and communicates with the ventilating duct at the other end and a second ventilating path which is open to the drum at one end and communicates with the first ventilating path at the other end, said drying apparatus further comprising a first lint filter attached to said one end of the first ventilating path and a second lint filter attached to the other end of the second ventilating path.

13. A drying apparatus according to claim 12 further comprising a second lint filter attached to the other end of the second ventilating path.

14. A drying apparatus according to claim 13, wherein said outer box has an opening for cleaning the second lint filter, which is positioned to face the second lint filter, and a cover detachably attached to the outer box to close the opening.

15. A drying apparatus comprising:

an outer box including a drum mounted in said outer box for rotatable movement, said drum for housing moist materials to be dried;

heater means for heating air;

air supply means operatively associated with said heater means for supplying heated air to said drum to remove moisture from said moist materials housed in said drum;

means defining a recycle path between an outer surface of said drum and an inner surface of said outer box, said recycle path having a first end in fluid communication with said drum and a second end in fluid communication with said air supply means, said recycle path defining means for directing moist air discharged from said drum at said first end and returning said discharged air to said air supply means wherein the discharged air is again supplied to said drum, said recycle path defining means at said first end including ventilator means defining first and second ventilator paths, each said first and second ventilator paths having one end in communication with said drum to permit said discharged air to flow into said first and second ventilator paths, said first path having another end in communication with said recycle path and said second ventilator path having another end in communication with said first ventilator path; and moisture-removing means operatively disposed in said recycle path between said ventilator means and said second end, said moisture-removing means for cooling said moist discharged air to remove moisture therefrom so that cool dried air is returned to said air supply means to be once again heated by said heater means and supplied to said drum by said air supply means.

16. A drying apparatus as in claim 15 wherein said first ventilator path at said one end thereof includes first filter means to filter said discharged air flowing in said first ventilator path to said recycle path and wherein said second ventilator path at said another end thereof includes second filter means to filter air flowing in said second ventilator path to said first ventilator path.

17. A drying apparatus as in claim 16 wherein said outer box includes an opening adjacent said second filter means and cover means removeably covering said opening to permit access to said second filter means.

18. A drying apparatus as in claim 17 wherein said first and second filter means are opposingly disposed relative to one another.

* * * * *